United States Patent [19]

Hartt

[11] Patent Number: 5,007,812

[45] Date of Patent: Apr. 16, 1991

[54] HYDRAULIC PUMP WITH PULSATING HIGH AND LOW PRESSURE OUTPUTS

[76] Inventor: Joseph R. Hartt, 6352 S. Poplar Ct., Englewood, Colo. 80122

[21] Appl. No.: 402,603

[22] Filed: Sep. 5, 1989

[51] Int. Cl.[5] ..... F04B 21/02

[52] U.S. Cl. ..... 417/534; 417/404

[58] Field of Search ..... 417/397, 404, 534

[56] References Cited

U.S. PATENT DOCUMENTS

| | | | |
|---|---|---|---|
| 2,508,298 | 5/1950 | Saari | 417/225 |
| 2,951,745 | 9/1959 | Sweet et al. | 417/397 |
| 3,086,470 | 4/1963 | Skipor et al. | 417/425 |
| 3,174,409 | 3/1965 | Hill | 91/306 |
| 3,489,100 | 1/1970 | Hill | 91/307 |
| 3,963,383 | 6/1976 | Hill | 91/307 |
| 4,163,632 | 7/1979 | Hichman et al. | 417/318 |
| 4,368,008 | 1/1983 | Budzich | 417/397 |
| 4,527,959 | 7/1985 | Whiteman | 417/397 |
| 4,793,153 | 12/1988 | Hembree et al. | 62/476 |

FOREIGN PATENT DOCUMENTS

| | | | |
|---|---|---|---|
| 514674 | 3/1921 | France | 417/397 |

*Primary Examiner*—A. Michael Chambers

*Attorney, Agent, or Firm*—Fields, Lewis, Pittenger & Rost

[57] ABSTRACT

A hydraulic pump provides two different fluid pressure outputs from a single input. The pump includes a first double acting piston and cylinder having a pair of inlets on opposite sides of the first piston and a pair of outlets on the opposite sides of the first piston. A second double acting piston and cylinder are provided which cylinder has a pair of inlets on opposite sides of the second piston and a pair of outlets on opposite sides of the second piston. A common piston rod interconnects the pistons and means is provided for alternately supplying fluid to the first inlets of the first and second cylinders on one side of the pistons and then to the first inlets on the other side of the first and second pistons to cause the first and second pistons to reciprocate within the first and second cylinders, respectively. In this manner, the first piston discharges fluid through an outlet on the opposite side of the first piston from the inlet through which the fluid enters to provide high pressure pulsating fluid flow from the outlets of the first cylinder and the second piston discharges fluid through an outlet of the opposite side of the second piston from the inlet through which the fluid enters to provide low pressure pulsating fluid flow from the output of the second cylinder.

17 Claims, 2 Drawing Sheets

HYDRAULIC PUMP WITH PULSATING HIGH AND LOW PRESSURE OUTPUTS

TECHNICAL FIELD

This invention relates to a hydraulic pump and more particularly to a hydraulic pump having a single fluid inlet and two fluid outlets providing simultaneous pulsating streams at two different pressures.

BACKGROUND ART

Prior to the present invention, no means has been found to provide simultaneous high and low pressure pulsating streams without the use of separate apparatus to provide each pulsating stream. To provide two separate apparatuses to provide two pulsating output streams at different pressures is expensive and may create space requirements which are impractical for particular applications.

U.S. Pat. No. 2,508,298 to Saari has a fluid pressure intensifier using a pair of pistons and piston rods, respectively. Flow is controlled by spool valves. This device provides a single higher pressure fluid output from a single fluid input. On the reverse half cycle of each piston, fluid is discharged through a drain at low pressure.

U.S. Pat. No. 3,086,470 to Skipor, et al. has a pump motor combination attached by a tubular connecting rod with a timing rod affixed to its ends which controls a valve unit. This device provides a single pulsating output at high pressure wherein low pressure fluid is discharged on the opposite half of the cycle.

U.S. Pat. No. 3,174,409 to Hill discloses a pump driven by gas and having a gas operated control valve to reciprocate a gas piston. This piston movement provides a pulsating fluid discharge which may be greater than the fluid line pressure.

U.S. Pat. No. 3,489,100 discloses a pump driven by gas or manually or both to reciprocate a gas piston. This also provides a pulsating fluid discharge which may be greater than the fluid line pressure.

U.S. Pat. No. 3,963,383 to Hill discloses an improvement of U.S. Pat. No. 3,174,409 which includes a spring means for moving the gas piston in one direction of its cycle.

U.S. Pat. No. 4,163,632 to Hinchman, et al. discloses a hydraulic pump mechanically connected to a fluid motor control valve. In one embodiment, the device includes a double-acting motor and pumps and a slide control valve connected to the piston of the motor. The slide valve is controlled by a rod which strikes pins as the motor piston moves reciprocally. This causes the valve to be shifted mechanically at the end of each stroke to reverse the direction of the piston. One fluid is used for operating the motor and the pump pumps a second fluid.

U.S. Pat. No. 4,793,153 to Hembree, et al. discloses a first low pressure liquid entering the cylinders of a pump and exhausted at a higher pressure by a second high pressure liquid which drives the pump. A third liquid drives the motor and exhausts in a vapor/liquid mixture which helps drive the motor as the vapor expands. Electrical switches are provided at the end of the travel of the pump pistons causing valves to be electrically switched from a first to a second position and back again. Energy is transferred from the second and third liquids to the first liquid to create the high pressure. The piston areas are unequal in the motor and only one high pressure outlet is provided. There is no concept of providing both pulsating high and low pressure outputs.

DISCLOSURE OF THE INVENTION

In accordance with the present invention, a hydraulic pump is provided for providing two different fluid pressure outputs from a single input. The pump includes a first double acting piston and a first cylinder having a pair of inlets on opposite sides of the first piston and a pair of outlets on the opposite sides of the first piston. A second double acting piston and second cylinder are provided, the second cylinder having a pair of inlets on opposite sides of the second piston and a pair of outlets on opposite sides of the second piston. A common piston rod interconnects the pistons and means is provided for alternately supplying fluid to the first inlets of the first and second cylinders on one side of the pistons and then to the first inlets on the other side of the first and second pistons to cause the first and second pistons to reciprocate within the first and second cylinders, respectively. In this manner, the first piston discharges fluid through an outlet on the opposite side of the first piston from the inlet through the which fluid enters to provide high pressure pulsating fluid flow from the outlets of the first cylinder and the second piston discharges fluid through an outlet on the opposite side of the second piston from the inlet through which the fluid enters to provide low pressure pulsating fluid flow from the output of the second cylinder.

The fluid supply means includes a valve reciprocally movable from a first position in which fluid is admitted through the first inlet of the first and second cylinders and is discharged through the outlets on the opposite side of the pistons and a second position in which fluid is admitted through the second inlets of the first and second cylinders and is discharged through the other outlets on the opposite sides of the pistons. The valve includes a first pair of inlet openings alignable with the first inlets, respectively, when the valve is in the first position. A second pair of inlet openings are alignable with the second inlets, respectively, when the valve is in the second position. Similarly, a first pair of outlet openings are alignable with the outlets, respectively, on the opposite sides of the piston from the first inlet and a second pair of outlet openings is alignable with the outlets, respectively, on the opposite side of the piston from the second inlet.

An actuator arm is attached to a fixed pivot intermediate its ends and has one end pivotally attached to the valve. A pair of spaced members are connected to the piston rod and are movable therewith so that near the end of the stroke of the pistons in one direction, one of the members engages the other end of the actuator arm to pivot the actuator arm past center in one direction to snap the valve from the first position to the second position. Near the end of the stroke of the piston in the opposite direction, the other of the members engages the other end of the actuator arm to pivot the actuator arm past center in the opposite direction to snap the valve from the second position to the first position. Spring means can be provided which tends to hold the actuator arm in each of the past center positions.

In one embodiment of the invention, one of the pistons and cylinders is larger than the other piston and cylinder. In an alternative embodiment they are of substantially equal size.

It is also contemplated that the outlet line of one cylinder may be connected to a different high pressure line than the high pressure outlet of the other cylinder. Similarly, the low pressure outlet of one cylinder may be connected to a different low pressure line than the low pressure output of the other cylinder. Thus, during one half cycle fluid will be discharged out of one set of high pressure lines and one set of low pressure lines whereas on the other half cycle the fluid will be discharged out of a second set of high pressure lines and low pressure lines. For certain types of applications this alternate cycling may be desirable.

Additional advantages of the invention will become apparent from the description which follows, taken in conjunction with the accompanying drawings.

BEST MODE FOR CARRYING OUT THE INVENTION

Figure 1:
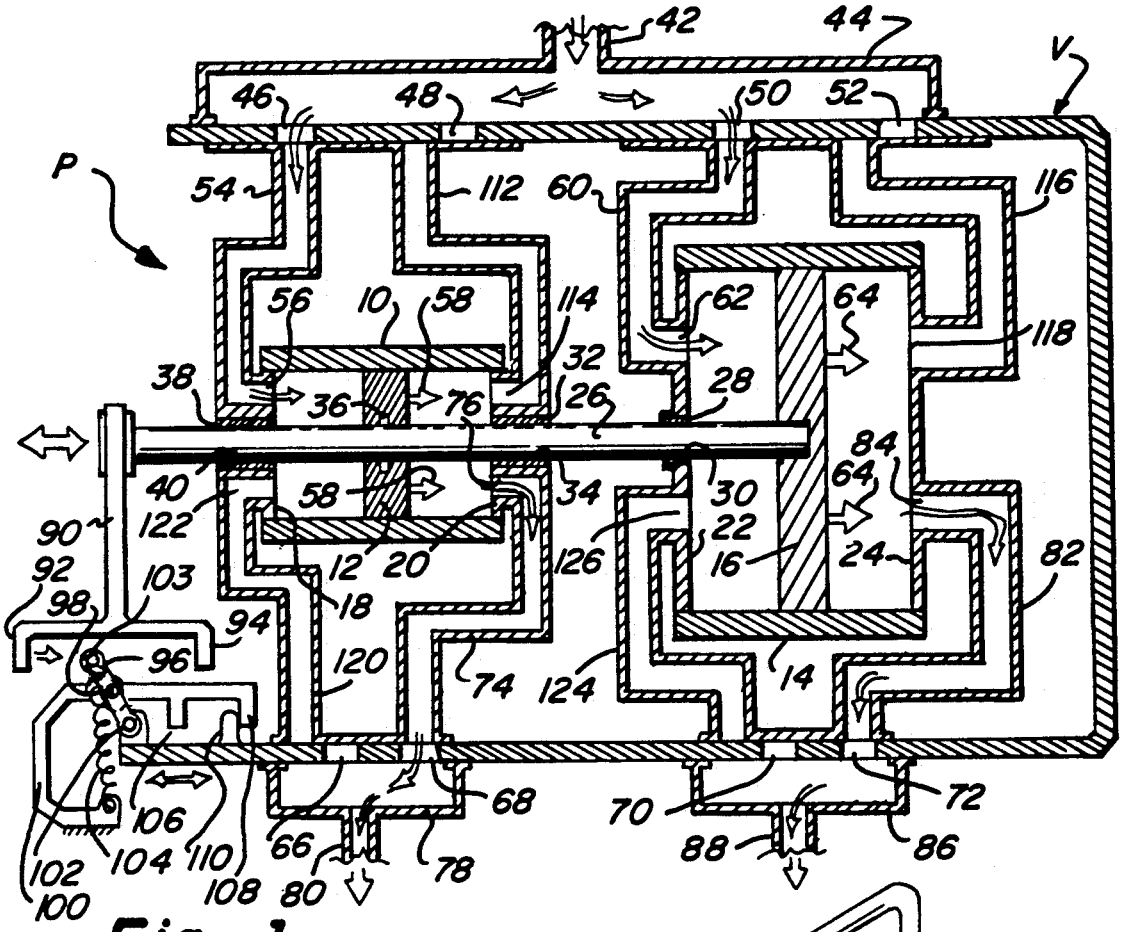
FIG. 1 is a diagrammatical view of one form of a hydraulic pump constructed in accordance with this invention.

In accordance with one form of this invention, a first smaller cylinder 10 is provided which has a reciprocating double acting piston 12 therein. Mounted coaxially with this first cylinder and piston is a larger second cylinder 14 having a reciprocal double acting piston 16 therein. Cylinder 10 has end walls 18 and 20 between which piston 12 reciprocates. Similarly, large cylinder 14 has end walls 22 and 24 between which cylinder 16 reciprocates. Conveniently, the pistons 12 and 16 are interconnected by a common piston rod 26. One end of the piston rod is fixedly attached to large piston 16 and passes through a seal 28 in the opening 30 of end wall 22. Piston rod 26 also extends through a seal 32 in opening 34 of end wall, 20 of smaller cylinder 10. The piston rod then passes through the center of piston 12 and is attached thereto, as by a snap ring 36. Finally, the piston rod 26 passes through a seal 38 in opening 40 of end wall 18.

To operate the pump, a substantially non-compressible fluid, such as water, is supplied at line pressure through an inlet 42 to an inlet manifold 44 connected to a reciprocal valve, such as slide valve V. Conveniently, valve V is provided with a first pair of spaced inlet openings 46 and 48 and a second pair of inlet openings 50 and 52. When the slide valve is in the position shown, opening 46 is aligned with conduit 54 to supply fluid through a first inlet 56 in end wall 18 of cylinder 10 to urge piston 12 to the right in the direction of arrows 58. Similarly, inlet opening 50 is aligned with conduit 60 to provide fluid through inlet 62 in end wall 22 of cylinder 14 to also move piston 16 to the right as shown by arrows 64.

Slide valve V also has a first pair of outlet openings 66 and 68 and a second pair of outlet openings 70 and 72. When the slide valve is in the position shown, outlet opening 68 is aligned with conduit 74 which puts it into fluid communication with outlet 76 in end wall 20 of cylinder 10. Thus, as piston 12 moves to the right, fluid on the right side of the piston will be discharged through outlet 76, conduit 74 and opening 68 into high pressure manifold 78 from which it is discharged through high pressure line 80. Similarly, outlet opening 72 is in fluid communication with conduit 82 connected to outlet 84 of end wall 24 of cylinder 14. Thus, as piston 16 moves to the right, fluid will be discharged through outlet opening 84, conduit 82 and opening 72 into a low pressure manifold 86 and through low pressure line 88.

An activator arm 90 is connected to the outwardly extending end of piston rod 26 for movement therewith and terminates in a pair of spaced end members 92 and 94. Conveniently, an actuator arm 96 is pivoted intermediate its ends by a pivot pin 98 connected to a fixed support 100. The lower end of actuator arm 96 is pivoted to slide valve V by a pivot pin 102 and the free end or upper end 103 is connected to a spring 104 which extends between actuator arm 96 and fixed support 100, as shown. Support 100 also includes spaced stops 106 and 108 which are engagable by stop 110 on slide valve V.

When piston rod 26 moves to the right and nears the end of its stroke, end member 92 will engage the upper end of actuator arm 96 and cause it to pivot in a clockwise direction which will move slide valve V to the left from the position shown so that stop 110 is moved away from stop 108 and over into engagement with stop 106. Spring 104 assists in causing lever 96 to snap past center as it is rotated in the clockwise direction. When slide valve V is moved to the left, inlet opening 48 will be brought into communication with conduit 112 which will direct fluid from the line through inlet 114 in end wall 20 of cylinder 10. This fluid will cause piston 12 to begin moving to the left. Similarly, the movement of slide valve V to the left will bring inlet opening 52 into alignment with conduit 116 connected to inlet 118 in end wall 24 of cylinder 14 thereby causing piston 16 to be moved to the left. Of course, when in the left-hand position, inlets 46 and 50 of slide valve V will no longer be aligned with conduits 54 and 60, thereby blocking fluid flow to the left side of the respective cylinders 12 and 16.

The movement of slide valve V to the left will also bring outlet 66 into alignment with conduit 120 so that fluid on the left-hand side of piston 12 will be discharged through outlet 122 in end wall 18 into the conduit and through outlet opening 66 into high pressure manifold 78 and through high pressure line 80. Similarly, outlet opening 70 of slide valve V will be brought into alignment with conduit 124 so that fluid on the left-hand side of piston 16 will be discharged through outlet 126 in end wall 22 of cylinder 14 into conduit 124 and through outlet 70, low pressure manifold 86 and through low pressure line 88.

As piston rod 26 nears the left-hand end of its stroke, end member 94 will engage the upper end of actuator arm 96 pivoting it in a counter clockwise direction so that it passes over center and moves slide valve V to the right so that stop 110 is moved away from stop 106 and again engages stop 108. It is apparent that this reciprocal motion of the pistons and piston rod will result in a single fluid at line pressure being used to actuate the pump and to provide output fluid at two distinct pressures. Thus, simultaneous pulsating high and low pressure outputs can be provided from a single input of predetermined pressure. For many applications, a ratio of about 2:1 between the high pressure output and the low pressure output have been found satisfactory.

It will be apparent to one skilled in the art that other types of values may be used to carry out the present invention. For example, a rotary valve would be entirely satisfactory. If desired, electronic sensing and activating means could be provided at the end of each stroke to snap the valve from one position to the other.

Figure 2:
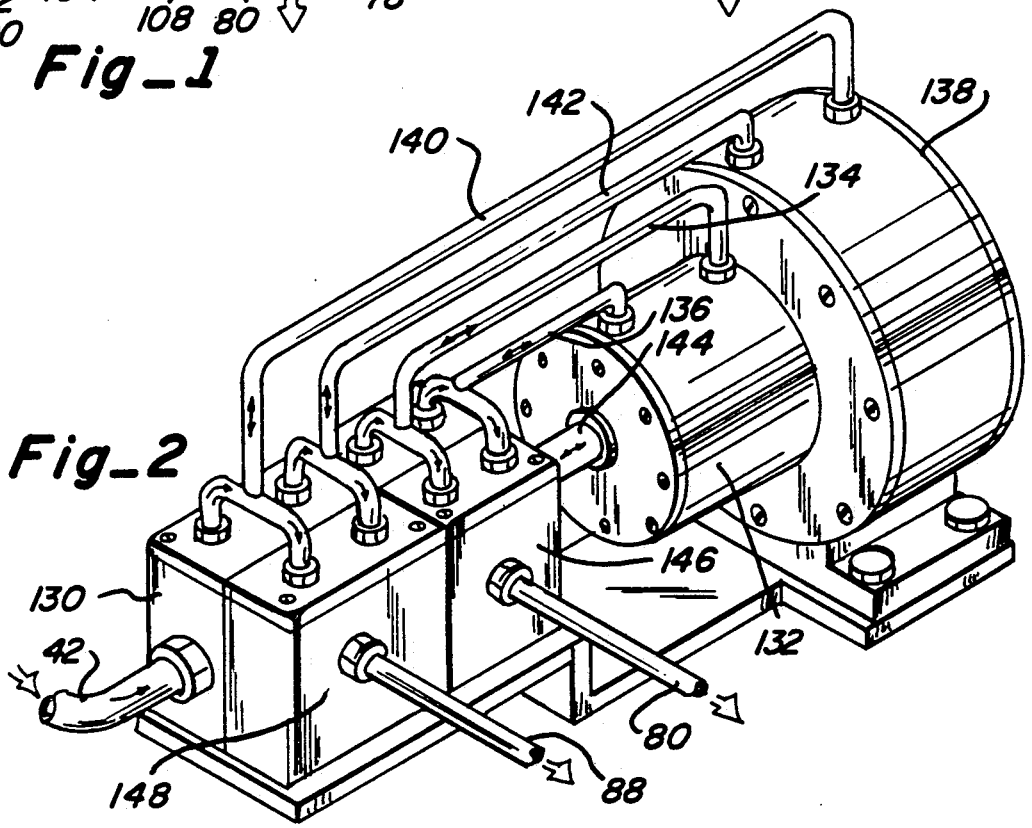
FIG. 2 is a perspective view of the hydraulic pump of this invention, shown in a proposed commercial embodiment.

A proposed commercial structure for the embodiment of the present invention just described is shown in FIG. 2. Fluid enters from line inlet 42 into a manifold 130 which supplies fluid to a small cylinder 132 through conduits 134 and 136. Similarly, fluid is alternately supplied to large cylinder 138 through conduits 140 and 142. The reciprocal motion of a common piston rod 144 operates a slide valve (not shown) located within manifold 130 to alternate the fluid supplies from one side of the cylinders to the other. The fluid discharged from small cylinder 132 is alternately discharged from opposite ends into high pressure manifold 146 for pulsating discharge through high pressure line 80. Similarly, discharge fluid from large cylinder 138 is alternately supplied from opposite ends through conduits 140 and 142 to low pressure manifold 148 for pulsating discharge through low pressure line 88.

Figure 3:
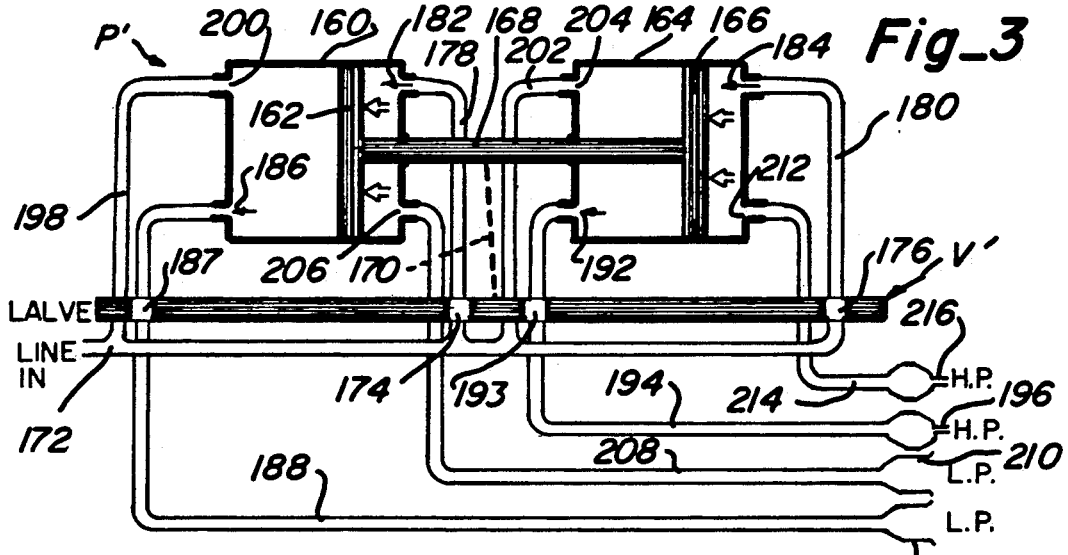
FIG. 3 is a diagrammatic view of an alternative form of the invention.

An alternative embodiment is shown in FIG. 3 wherein a first cylinder 160 is provided with a first piston 162 reciprocally mounted therein. A second cylinder 164 is provided which is of substantially the same size as cylinder 160 and has a reciprocal piston 166 therein. The pistons are interconnected by a common piston rod 168, as shown. Piston rod 168 is connected to a valve such as slide valve V' by control means 170. This control means may take any suitable form but may be similar to the control mechanism shown in FIG. 1, whereby valve V' will be snapped from one position to the other when the pistons approach the end of their stroke in each direction.

The pistons are supplied with fluid through an inlet line 172. With valve V' in the position shown, the fluid will pass through inlet openings 174 and 176, respectively, and through inlet lines 178 and 180, respectively, and finally through inlet 182 of cylinder 160 and inlet 184 of cylinder 164. The fluid pressure will cause the pistons 162 and 166 to move to the left, as viewed in FIG. 3. The fluid on the other side of piston 162 will be discharged through a first outlet 186 in cylinder 160, through valve outlet 187 and through low pressure line 188 connected to a low pressure outlet 190. Similarly, the fluid on the opposite side of piston 166 will flow through a first outlet 192 of cylinder 164, through valve outlet 193 and through a high pressure line 194 to a high pressure outlet 196. When the pistons reach the left-hand of their stroke, the control mechanism 170 will snap the valve V' to the left from the position shown. This will bring opening 187 of valve V' into alignment with inlet line 198 so that it is communication with inlet line 172. This will supply line pressure through a second inlet 200 of cylinder 160 which is on the opposite side of piston 162 from previously described inlet 182. Line pressure will also be supplied from inlet line 172 through valve opening 193 and through inlet line 202 which is in communication with inlet 204 of cylinder 164 for supplying fluid to the opposite side of piston 166 from previously described inlet 184. Thus, the line pressure will cause pistons 162 and 166, respectively to begin moving to the right, as viewed in FIG. 3.

As the pistons move to the right, the fluid to the right of piston 162 will be discharged through outlet 206 of cylinder 160, through valve opening 174 and out low pressure line 208 to low pressure outlet 210. Similarly, on the right-hand side of piston 166, the fluid will be discharged through outlet 212 of cylinder 164, through opening 176 of valve V' and through high pressure line 214 to high pressure outlet 216. Thus, it can be seen that during one half cycle there will be a high pressure outlet through high pressure outlet 196 and a low pressure output through low pressure outlet 190. Similarly, on the other half stroke there will be a high pressure output through high pressure outlet 216 and a low pressure output through low pressure outlet 210. This will provide alternating high and low pressure flow of the fluid as pistons 162 and 166 reciprocate within their respective cylinders 160 and 164.

Figure 4:
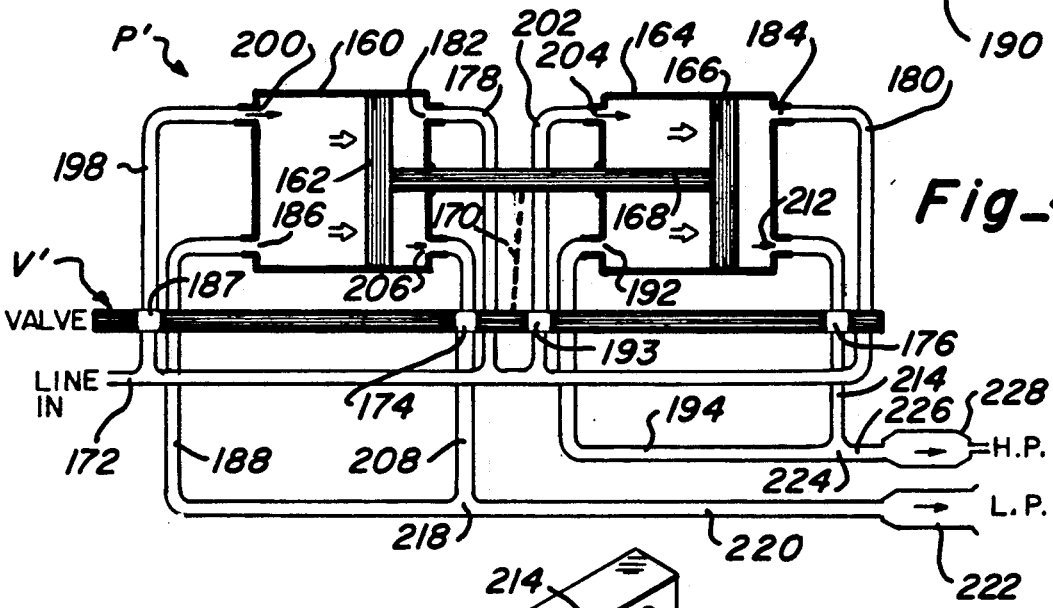
FIG. 4 is a diagrammatical view similar to FIG. 3 but showing alternative discharge lines.

The embodiments shown in FIG. 4 is identical to that of FIG. 3 except that low pressure lines 188 and 208 flow together at juncture 218 so that the flow of those low pressure lines then passes through low pressure line 220 to a single low pressure outlet 222. Similarly, high pressure lines 194 and 214 intersect at juncture 224 so that the flow from these lines then flows through high pressure line 226 to a single high pressure outlet 228. With this arrangement, during one half cycle a high pressure flow will be discharged through high pressure outlet 228 and a low pressure will be discharged through low pressure outlet 222. On the reverse half cycle another high pressure flow will occur through high pressure outlet 228 and a low pressure flow will occur through low pressure outlet 222. Thus, there will be a constantly pulsating flow through the respective high and low pressure outlets.

Figure 5:
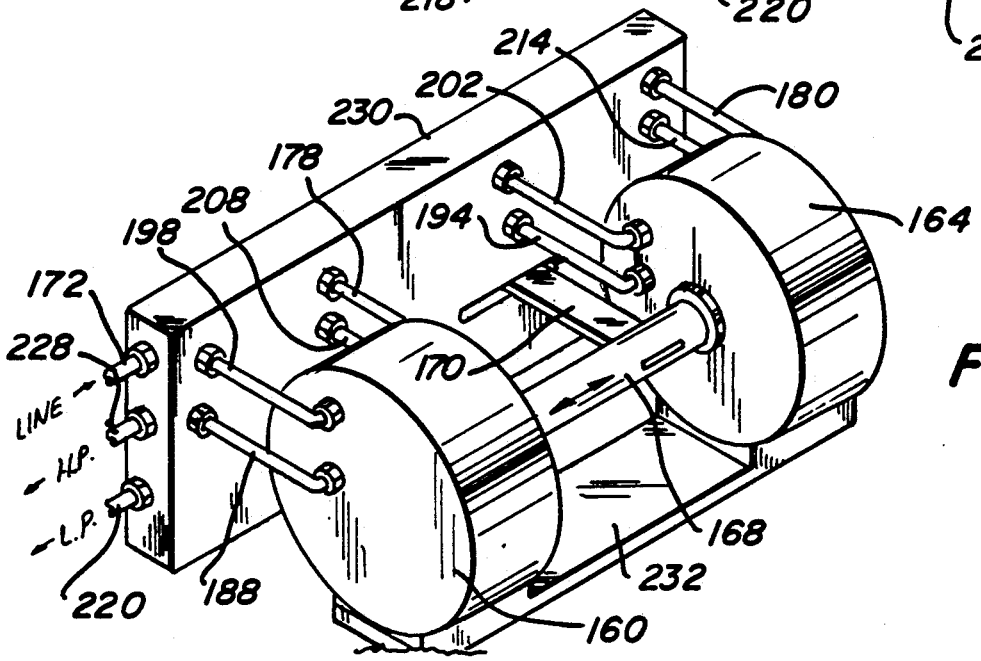
FIG. 5 is a proposed commercial embodiment of the device of FIG. 4.

FIG. 5 shows a proposed commercial embodiment for the structures schematically shown in FIG. 4. The valve V' would be located within housing 230 and the cylinders 160 and 164 are conveniently supported on a base 232, as shown.

From the foregoing, the advantages of this invention are readily apparent. A hydraulic pump has been provided wherein a single fluid is supplied at line pressure to a first and second cylinder to drive the pistons therein simultaneously. The fluid is discharged from the cylinders at high and low pressure, respectively, and because of the reciprocal motion of the cylinders the fluid is discharged simultaneously in two separate pulsating streams, one stream being at a higher pressure than the other. The cylinders can be the same size or one can be larger than the other. The larger the differential in the cylinders, the greater the differential of the high pressure output to the line input. However, for some applications with the cylinders maybe the same size and provide a high pressure output which is 60% to 80% greater than the line input. Additionally, separate high pressure line outputs and low pressure line outputs can be provided for each cylinder so that on each half cycle there is a discharge of fluid through only those outlets connected to each high pressure and low pressure output lines.

This invention has been described in detail with reference to particular embodiments thereof, but is will be understood that various other modifications can be effected within the spirit and scope of this invention.

I claim:

1. A method for providing a pulsating high pressure fluid output simultaneously with a pulsating low pressure output from a single high pressure, substantially non-compressible fluid input comprising the step of:

supplying a substantially non-compressible fluid from a single fluid supply inlet at a first pressure simultaneously to one side of a first cylinder of given diameter and one side of a second cylinder of given diameter to move a piston within each cylinder from one end thereof to the other; and simultaneously discharging the same fluid from the first cylinder on the side of the piston opposite the one side at a high pressure and from the second cylinder on the side of the piston opposite the one side at a lower pressure.

2. A method, as claimed in claim 1, including the further step of:

alternately supplying the same fluid simultaneously to opposite sides of the cylinders as the pistons reach the end of their stroke; and alternately discharging the same fluid simultaneously from the opposite side of the cylinders than the side to which fluid is being supplied.

3. An hydraulic pump for providing a simultaneous pulsating high pressure and pulsating low pressure fluid output from a single, substantially non-compressible fluid input at a predetermined pressure, said pump comprising:

a first double acting piston and cylinder having first diameters, respectively, said first cylinder having a pair of first and second inlets on opposite sides of said first piston and a pair of first and second outlets on the opposite side of said first piston;

a second double action piston and cylinder having second diameters, respectively, said second cylinder having a pair of first and second inlets on opposite sides of said second piston and a pair of first and second outlets on opposite sides of said second piston;

a common piston rod interconnecting said pistons; and means for alternately supplying a single, substantially non-compressible fluid to said first inlets of said first and second cylinders on said one side of each of said of said pistons, and then to said first inlets on said other side of each of said pistons to cause said first and second pistons to reciprocate within said first and second cylinders, respectively, so that said first piston discharges the same fluid through an outlet on the opposite side of said first piston from the inlet through which fluid enters to provide high pressure pulsating fluid output from said outlets of said first cylinder and said second piston discharges the same fluid through an outlet on the opposite side of said second piston from the inlet through which fluid enters to provide low pressure pulsating fluid output from said outlets of said second cylinder.

4. Apparatus, as claimed in claim 3, wherein:

said second diameters are larger than said first diameters, respectively.

5. Apparatus, as claimed in claim 3, wherein:

said first diameters are approximately the same as said second diameters, respectively.

6. Apparatus, as claimed in claim 3, further including:

first and second conduits each having a first and second end, said first ends respectively being connected to said first and second outlets, respectively, of said first cylinder;

first means connected to said second ends of said first and second conduits to provide a pulsating high pressure output;

third and fourth conduits each having a first and second end, said first ends connected to said first and second outlets, respectively, of said second cylinder; and second means connected to said second ends of said third and fourth conduits to provide a pulsating low pressure output.

7. Apparatus, as claimed in claim 6, wherein:

at least one of said first means and said second means includes a single output line providing pulsating flow on each half cycle of said pump.

8. Apparatus, as claimed in claim 6, wherein:

at least one of said first means and said second means includes a pair of output lines alternately providing pulsating flow on each half cycle of said pump.

9. Apparatus, as claimed in claim 3, wherein said fluid supplying means includes:

a valve reciprocally movable from a first position in which fluid is admitted through said first inlets of said first and second cylinders and is discharged through said outlets on the opposite sides of said pistons and a second position in which fluid is admitted through said second inlets of said first and second cylinders and is discharged through said other outlets on the opposite sides of said pistons.

10. Apparatus, as claimed in claim 9, wherein said valve includes:

a first pair of inlet openigns alignable with said first inlets, respectively, when said valve is in said first position;

a second pair of inlet openings alignable with said second inlets, respectively, when said valve is in said second position;

a first pair of outlet openings alignable with said outlets, respectively, on said opposite side of said pistons from said first inlets; and a second pair of outlet openings alignable with said outlets, respectively, on said opposite side of said pistons from said second inlets.

11. Apparatus, as claimed in claim 10, further including:

means responsive to the position of said pistons to move said valve between said first and second positions.

12. A pneumatic pump for providing a simultaneous pulsating high pressure and pulsating low pressure fluid output from a single, substantially non-compressible fluid input at a predetermined pressure, said pump comprising:

a first cylinder of a given diameter having opposite ends and a first piston mounted for reciprocal movement therein between said ends;

a second cylinder of a given diameter mounted coaxially with respect to said first cylinder having opposite ends and a second piston mounted for reciprocal movement therein between said ends;

a common piston rod interconnecting said first and second pistons so that they move together;

a fluid supply line for supplying a substantially non-compressible fluid at a substantially constant line pressure;

first and second inlets in said opposite ends of each of said cylinders in fluid communication with said fluid supply line;

a high pressure discharge line;

a low pressure discharge line;

first and second outlets in said opposite ends of said first cylinder in fluid communication with said high pressure discharge line;

first and second outlets in said opposite ends of said second cylinder in fluid communication with said low pressure discharge line; and means responsive to the position of said pistons at one end of said cylinders to selectively bring said first inlets of said first and second cylinders into fluid communication with said fluid supply line to drive said pistons toward the opposite end of said cylinders, to block said second inlets from fluid communication with said fluid supply line, to bring said second outlets into fluid communication with said low pressure fluid line and said high pressure fluid line, respectively, to block said first outlets from fluid communication with said low pressure fluid line and said high pressure fluid line, respectively, and to reverse all of the open and closed inlets and outlet in response to said pistons reaching the opposite ends of said respective cylinders to reverse the direction of movement of said cylinders and to provide simultaneous pulsating high and low pressure fluid flow of the same fluid through said high and low pressure discharge lines, respectively.

13. Apparatus, as claimed in claim 12, wherein:

said given diameter of said second cylinder is larger than said given diameter of said first cylinder.

14. Apparatus, as claimed in claim 12, wherein:

said given diameter of said second cylinder is substantially equal to said given diameter of said first cylinder.

15. Apparatus, as claimed in claim 12, further including:

first and second conduits each having a first and second end, said first ends respectively being connected to said first and second outlets, respectively, of said first cylinder;

first means connected to said second ends of said first and second conduits to provide a pulsating high pressure output;

third and fourth conduits each having a first and second ends, said first ends connected to said first and second outlets, respectively, of said second cylinder; and second means connected to said second ends of said third and fourth conduits to provide a pulsating low pressure output.

16. Apparatus, as claimed in claim 15, wherein:

at least one of said firsts means and said second means includes a single output line providing pulsating flow on each half cycle of said pump.

17. Apparatus, as claimed in claim 15, wherein:

at least one of said first means and said second means includes a pair of output lines alternately providing pulsating flow on each half cycle of said pump.

* * * * *